US006612400B2

(12) United States Patent
Bravo

(10) Patent No.: US 6,612,400 B2
(45) Date of Patent: Sep. 2, 2003

(54) ELECTRONICALLY CONTROLLED VARIABLE LOUDNESS MUFFLER

(76) Inventor: Andres E. Bravo, 4141 N. Miami Ave., Suite 210, Miami, FL (US) 33127

( * ) Notice: Subject to any disclaimer, the term of this patent is extended or adjusted under 35 U.S.C. 154(b) by 0 days.

(21) Appl. No.: 10/039,065

(22) Filed: Jan. 5, 2002

(65) Prior Publication Data

US 2003/0127281 A1 Jul. 10, 2003

(51) Int. Cl.[7] ..... F01N 1/00
(52) U.S. Cl. ..... 181/254; 84/253
(58) Field of Search ..... 181/254, 253, 181/255, 256, 258, 259

(56) References Cited

U.S. PATENT DOCUMENTS 4,913,260 A * 4/1990 Fallon ..... 181/254
5,959,263 A * 9/1999 Foltz, Jr. ..... 181/254

* cited by examiner

*Primary Examiner*—Kimberly Lockett

(57) ABSTRACT

The invention concerns an exhaust silencer arrangement with integrated bypass assembly and external actuator to control the position of the bypass assembly. For applications where a heightened loudness, or increased horsepower through the decrease of exhaust noise suppression is desired or required, but at temporary instances, the invention allows for real time electronic control over the loudness and horsepower potential of the internal combustion engine to which it is applied. The invention is comprised of the exhaust muffler with integrated bypass and silencer module, external electronic actuator, and the mechanical cable which transmits the mechanical output of the actuator to the bypass valve of the exhaust muffler assembly. The exhaust muffler is comprised of the housing which contains the bypass tube and valve assembly, silencer module, and inlet and outlet chambers which intersect the bypass assembly with the silencer module. The actuator is a Direct Current unit that converts the 12 volt DC power of the vehicle to a linear displacement for repositioning the bypass valve via the connection of the mechanical cable from the actuator rod, pulley, or lever to the bypass valve of the exhaust muffler assembly. The invention is configured to directly replace a vehicle's OEM exhaust muffler.

12 Claims, 5 Drawing Sheets

ELECTRONICALLY CONTROLLED VARIABLE LOUDNESS MUFFLER

BACKGROUND OF THE INVENTION

Mufflers exist in various designs and for various applications, but with a common function which is to reduce or alter the sound effects created by the internal combustion engine. The present invention functions by utilizing the basic principles of the muffler, which is to redirect and/or dampen the acoustic flow of the combustion sound waves However, this device differs from the common muffler in that it provides two additional features. While a muffler can alter certain attributes of the combustion exhaust, it does not allow for adjustment or real time control over the adjustment of those attributes. The two additional features provided by this device are the adjustment of the sound level of the exhaust of the engine and electronic control over that adjustment.

For applications where a heightened loudness and/or engine power is desired, switching to an aftermarket muffler will only provide a new sound output without any adjustment ability. The vehicle is now limited to the new modifications and can no longer provide some of the features of the initial set up. The most significant feature provided by an original equipment manufactured (OEM) muffler includes a minimal exhaust sound level output. This invention is simply an extension of a common muffler in the form of an additional integrated bypass assembly, which is employed via a throttling bypass valve, under the control of an electronically activated mechanical actuator. The manufacture of this device would then be simple in its design and production and reflect only a slight increase in cost from the common muffler.

BRIEF SUMMARY OF THE INVENTION

The primary object of the invention is to provide an engine exhaust muffler device, which can deliver minimum to maximum noise reduction under the control of an electronically activated mechanical actuator.

Using either a manual or automated switch, which can be located anywhere in the vehicle, a circuit is closed that activates a DC motor. This motor is the electromechanical output of a geared actuator connected to a steel wire, which at the other end is connected to the bypass gate of the rest of the device. The steel wire is insulated using a coiled wire which extends end to end. The ends of the insulation become part of the frames where the mechanical movement will occur, creating the linear displacement of the wire core during operation, relative to its insulation.

This setup allows for movement and flexibility of the wire. By utilizing a steel wire with wire insulation, the DC motor actuator device can be kept separate from the muffler device. The muffler section will reach high temperatures during operation, exceeding those which will damage the actuator unit. The two unique concepts of this invention are that the separation of the actuator unit and muffler assembly by use of a mechanical cable allows for the electronic control of this high temperature device, and the integrated bypass tube and valve allow for the incorporation of a complete and distinct muffler within the exhaust muffler assembly.

This invention can provide both the silence of an OEM muffler and the open delivery of unsuppressed engine exhaust. By throttling the gate valve through the activation of the actuator unit, various sound levels are attained. This then provides the option of a louder, stronger configuration back down to the silent OEM configuration, when the former is no longer desirable, and vice versa.

The invention can be manufactured to the size of a common muffler and requires minimal complexity in its fabrication. Since this device resembles the shape of a common muffler, with simple variation in its design, presented in the form of different models, it can be applied to almost any vehicle.

The invention is comprised of the exhaust muffler unit with integrated bypass assembly and silencing module, the DC actuator, and the mechanical cable, which transmits the linear motion of the actuator to the bypass valve of the exhaust muffler unit.

The exhaust muffler assembly consists of the housing, the bypass tube and valve assembly, the muffler module (silencer), and inlet and outlet chamber that intersect the bypass assembly, silencing module, and inlet and outlet pipes to the exhaust muffler assembly. The housing is in the shape of either an extruded oval or flattened octagon, with metal faces welded at the open ends. The inlet and outlet pipes are welded to opening in the faces positioned at the inlet of the bypass tube, and in the vicinity of the outlet of the silencing module, respectively.

The inlet pipe is positioned to flow directly into the bypass assembly. The bypass assembly consists of either a circular or square tube that extends from the inlet pipe to the final exhaust chamber. The valve assembly is a circular or rectangular gate, depending on the shape of its tubular housing. The size of the valve gate is slightly longer than the width of its housing to obtain a diagonal bypass, whose maximum degree can vary depending on application. The valve gate is pivoted at a distance from the inlet pipe so as to completely redirect the exhaust flow when the gate is closed, while allowing the gate to rotate parallel to the axis of the bypass tube without colliding with the inlet tube when the gate is open. When the valve is closed the exhaust will flow into the first chamber, which is at the inlet of the silencing chambers.

The silencing chamber contains the muffler module that resembles a typical muffler configuration, where maximum noise suppression is desired. This silencing module can either be a separate muffler unit, incorporated into the exhaust muffler assembly within the silencing chamber, or an integrated configuration where the silencing chamber is the silencing module. The exhaust of the silencing chambers lead into the final outlet chamber, which is at the inlet of the exhaust pipe. Utilizing the valve position that will completely redirect the exhaust flow through this path will return a silenced exhaust sound level.

The mechanical actuator is a 12 volt DC motor whose output is geared down to either a rotating lever or pulley, or linear displacement configuration to obtain the slower speed and higher torque required for effective operation. The fundamental purpose of the actuator is to convert the electrical energy provided by the vehicle to a linear displacement that will position the bypass valve gate, using the mechanical cable as the medium to transmit that motion. The actuator is controlled using a switching device (either manual or automated) that directs the DC current of the vehicle to the DC motor of the actuator.

The mechanical cable is a metal wire core which moves linearly with respect to the wire wound insulation that surrounds it. The wire core is simply a single or multi stranded wire, connected at one end to the actuator, and at the other end to the bypass valve assembly. The insulation is set at a fixed position with respect to the mechanism at the end to which it is attached; welded or crimped to the exhaust housing where the core is attached to the bypass valve assembly, and attached similarly at the opposite end to the frame of the actuator.

When the valve is set completely open, with the gate parallel to the axis of the inlet and outlet tubes, the exhaust flow moves directly from the inlet pipe through the bypass tube to the final chamber and into the exhaust pipe. Under this configuration the silencing chamber is bypassed by allowing direct flow from the inlet tube to the outlet tube. The valve can then be set at any position between maximum open and maximum close, providing the throttling control of the exhaust sound level. At maximum close, the valve directs the flow through the silencing chamber, out to the outlet pipe of the exhaust muffler assembly.

DETAILED DESCRIPTION OF THE INVENTION

Figure 1:
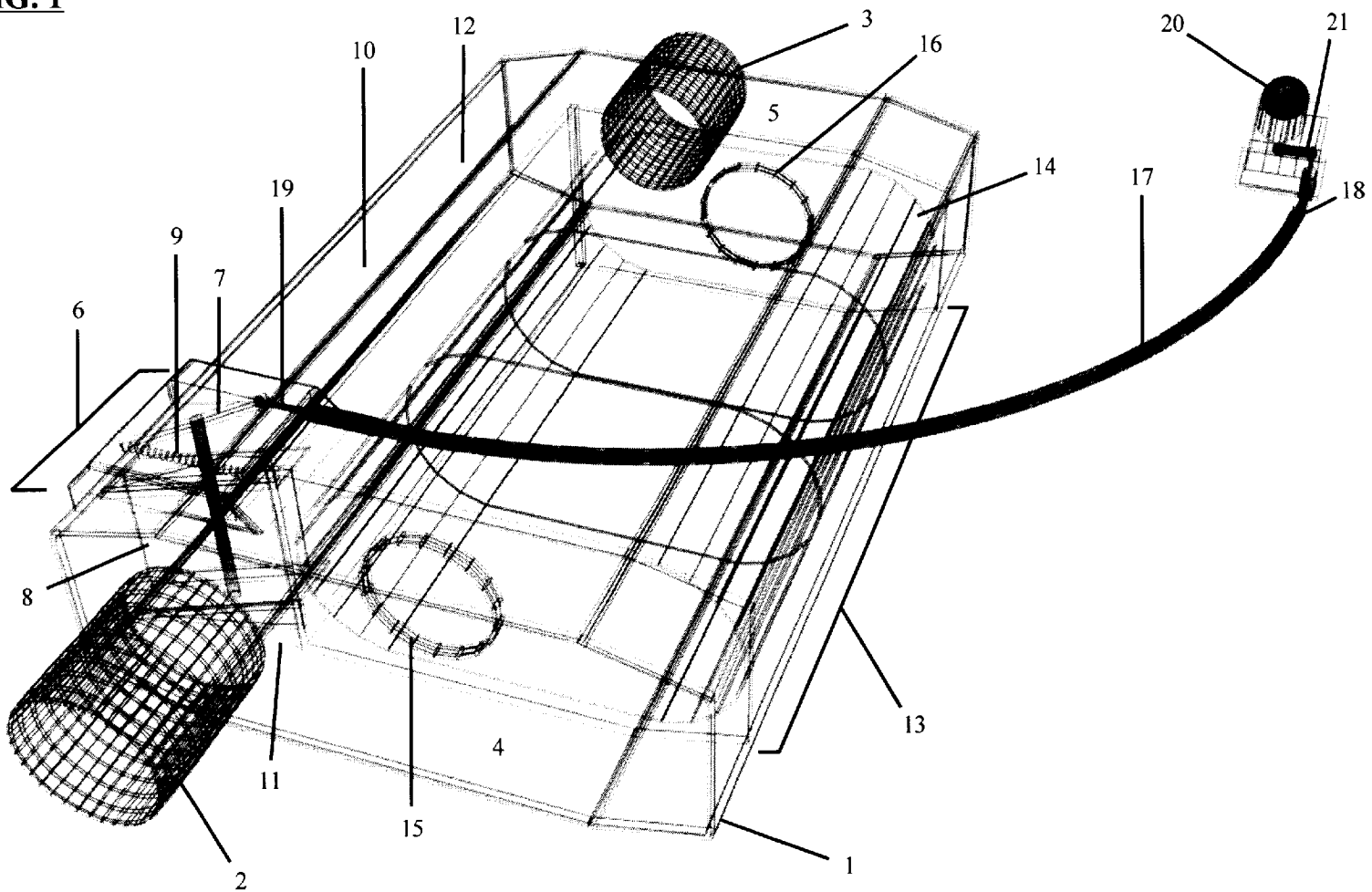
FIG. 1 shows a perspective view of an exhaust muffler arrangement with integrated bypass assembly and external DC motor unit.

According to drawing 1, an exhaust muffler arrangement comprises an exhaust muffler of a multi-chamber design, which is provided in any vehicle that utilizes an internal combustion engine, to include, but not limited to, passenger cars and trucks, with integrated bypass flow through a bypass tube to regulate output sound intensity. The exhaust muffler arrangement is arranged either in accordance with OEM specifications for the vehicle, or in a customized location for its required application.

The housing 1 of the exhaust muffler is in the shape of an extruded, flattened oval or octagon. It comprises either a single folded, or two halves combined of shape sheet metal welded at the seam using arc welding methods. The front and rear openings of the housing 1 are blocked off by metal sheets of equal thickness to that of housing 1, welded at their perimeters in their positions using abovementioned welding methods, circumscribed within the inner perimeter of housing 1.

On the front face created by the placement of the metal sheet of housing 1, adjacent to the smaller side of the front face of housing 1, that is perpendicular to the axis of the major sides of housing 1, is a circular opening centered with respect to its distance from the major sides of housing 1, to accommodate the positioning of muffler inlet tube 2. Muffler inlet tube 2 is positioned with its axis parallel to that of the housing 1, welded at the circumference of one end to the inner perimeter of the circular hole at the inlet side of housing 1, using arc welding methods. The opposite end of muffler inlet tube 2 is then welded to the exhaust pipe of the internal combustion engine to which it has been applied.

On the rear face created by the placement of the metal sheet of housing 1, centered with respect to all sides of the rear face of housing 1, is a circular opening, to accommodate the positioning of muffler outlet tube 3. Muffler outlet tube 3 is positioned with its axis parallel to that of the housing 1 and inlet tube 2, welded at the circumference of one end to the inner perimeter of the circular hole at the outlet side of housing 1, using arc welding methods. The opposite end of muffler outlet tube 3 is then welded to the outlet pipe of its application using aforementioned welding methods.

Muffler inlet chamber 4 is positioned at the inlet side of muffler housing 1, creating a separation between the front face of muffler housing 1 and the inlet face of muffler silencing chamber 13, a distance equal to the length of the opening of bypass tube 10, which is parallel to the axis of bypass tube 10.

Muffler outlet chamber 5 is positioned at the outlet side of muffler housing 1, creating a separation between the rear face of muffler housing 1 and the outlet face of muffler silencing chamber 13, a distance equal to the length of the opening of bypass tube 10, which is parallel to the axis of bypass tube 10.

Bypass valve 6 is created as an integral part of bypass tube 10, positioned with the axis of its pivot points, perpendicular to that of the planes of the major sides of muffler housing 1. Bypass valve gate 8 is positioned near the end of bypass tube 10, which is closest to the circular inlet of muffler housing 1, with the pivots of its axis at a distance from the muffler inlet tube 2, sufficient to allow bypass valve gate 8 to rotate and position the plane of its sides parallel to the axis of muffler inlet tube 2, centered at the midpoint of the circular opening, to which muffler inlet tube 2 is attached.

Bypass valve gate 8 is rectangular in shape with the axis of rotation perpendicular to its longest sides centered and parallel between its shortest sides and parallel to the plane created by its sides. The length of the shortest sides of bypass valve gate 8 is sufficient to extend between both sides of bypass tube 10 at the pivot location. The longest sides of bypass valve gate 8, which extend between the shortest sides, sufficient to allow only a limited rotation of bypass valve gate 8 along its axis. The operating angles of bypass valve gate 8 arranged between the parallel position of its plane to the axis of muffler inlet tube 2, to the maximum angle where the shortest side closest to the muffler inlet tube 2 will collide with the side of bypass tube 10 adjacent to the muffler housing 1, and the shortest side of bypass valve gate 8 closest muffler outlet tube 3 will collide with the side of the bypass tube 10 opposite to the aforementioned side and adjacent to muffler silencing chamber 13. Bypass valve gate 8 is positioned with its axel protruding through the pivot holes of bypass tube 10, with the axel extending sufficiently on one side to protrude past the outer surface of bypass tube 10 and extending sufficiently at the other end to intersect with bypass valve lever 7, at the outer surface of muffler housing 1.

Figure 2:
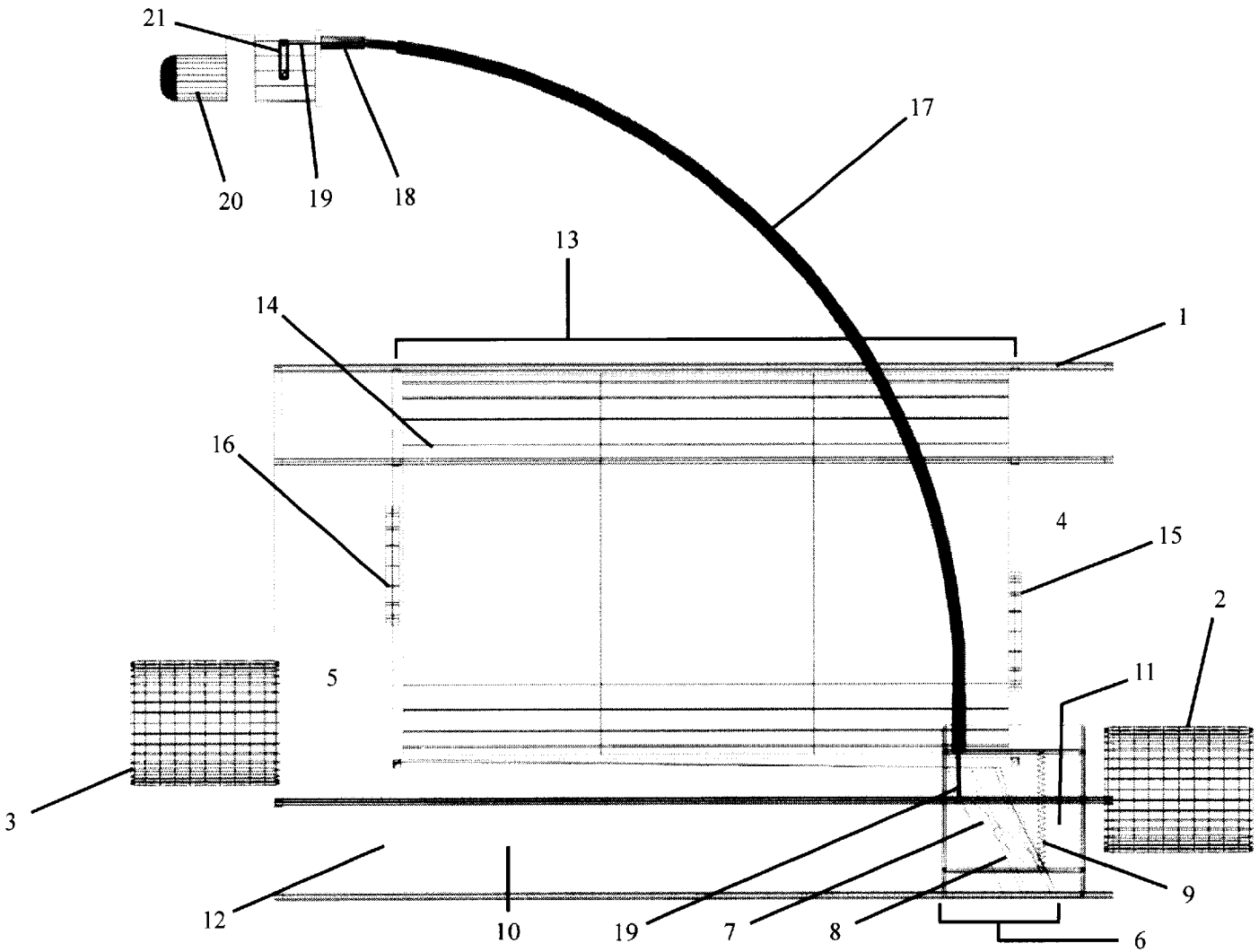
FIG. 2 shows a top view of the exhaust muffler arrangement according to FIG. 1.
Figure 3:
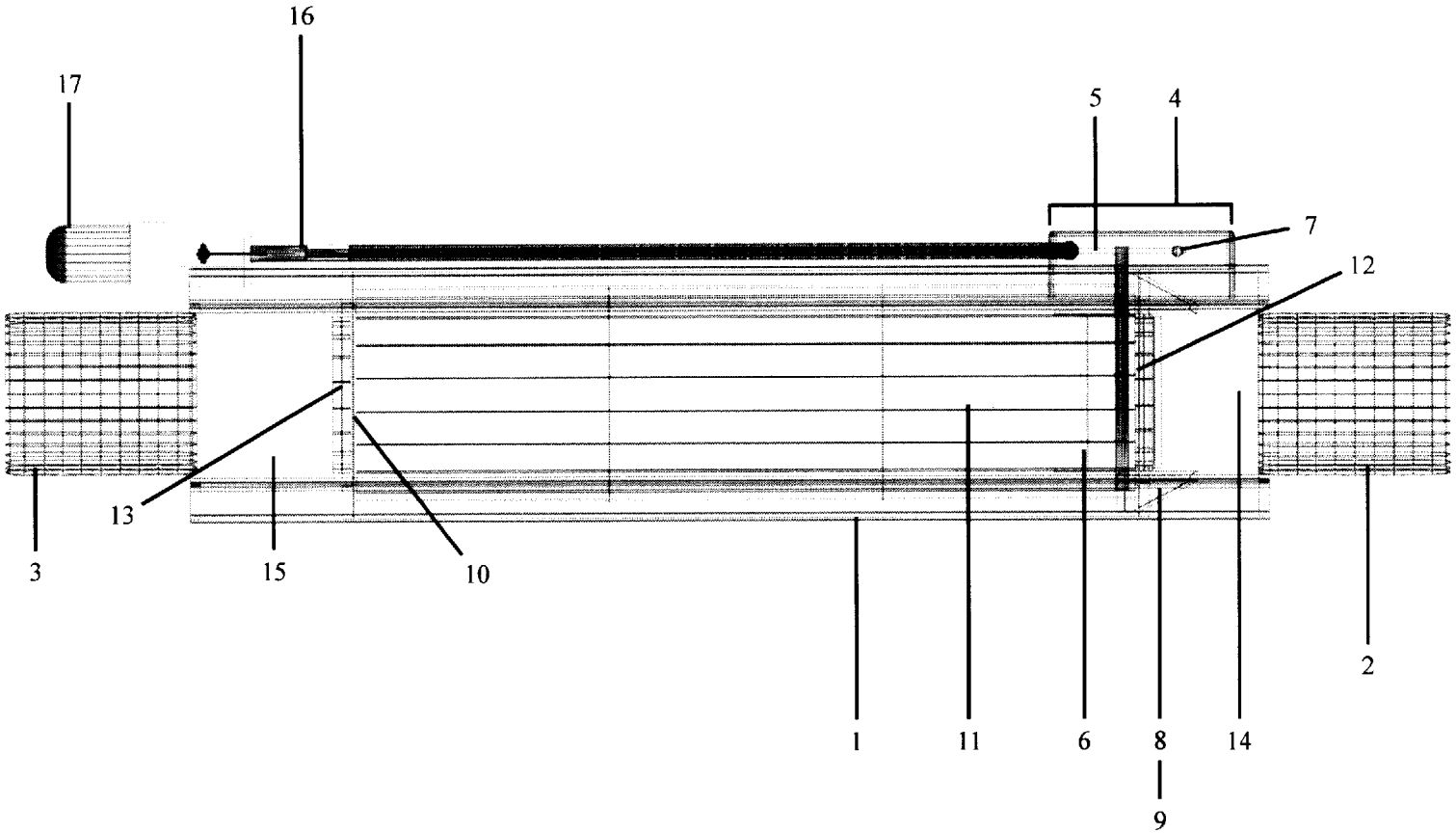
FIG. 3 shows a side view of the exhaust muffler arrangement according to FIG. 1.
Figure 4:
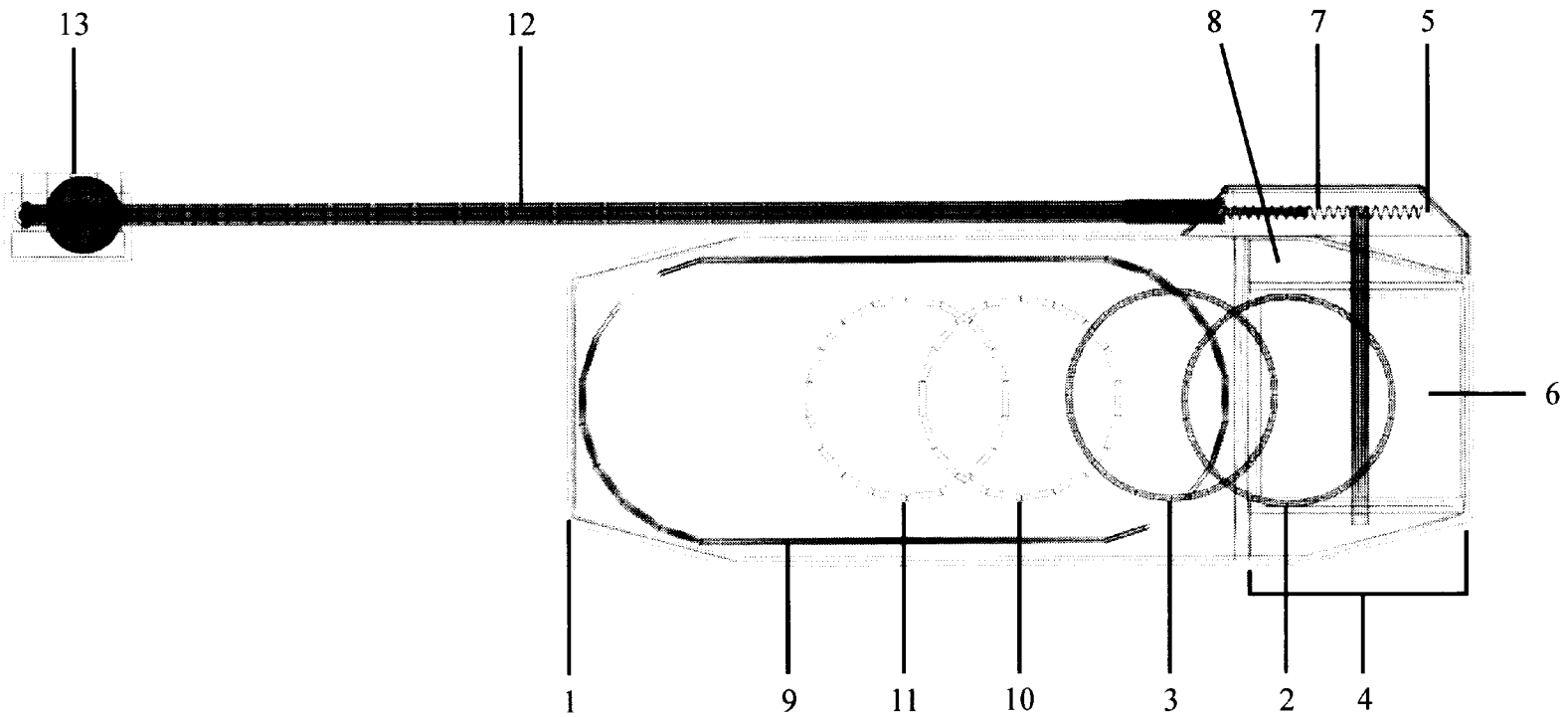
FIG. 4 shows an anterior view of the exhaust muffler arrangement according to FIG. 1.
Figure 5:
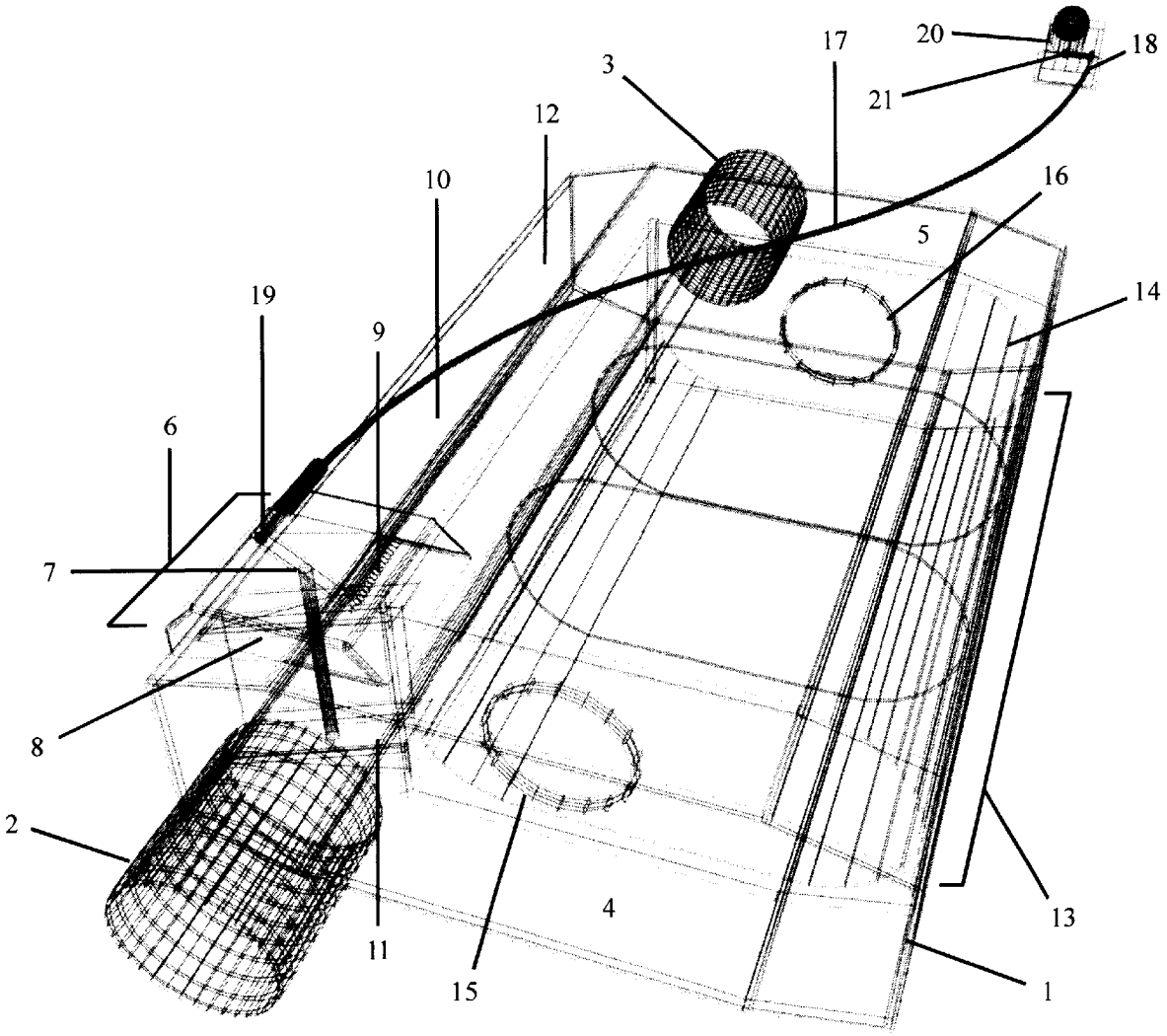
FIG. 5 shows another embodiment variant of an exhaust muffler arrangement similar to that in FIG. 1, with repositioned bypass valve lever assembly.

Bypass valve lever 7 is positioned with its pivot point of rotation welded to the axel of bypass valve gate 8 using arc welding methods, where it protrudes through muffler housing 1. The pivot point of bypass valve lever 7 is located between the attachment of bypass valve lever spring 9 and mechanical cable wire core 19. At one end of bypass valve lever 7 is attached bypass valve lever spring 9, which at the opposite end is attached to muffler housing 1 at a point which creates tension in lever spring 9 at all positions of valve lever 7. The opposite end of valve lever 7 is attached to one end of mechanical cable wire core 19. The position of bypass valve lever spring 9 is set parallel to cable wire core 19 with the end attached to muffler housing 1 positioned adjacent to the attachment of the mechanical cable insulation 18 to muffler housing 1. The positioning of bypass valve lever 7, bypass valve lever spring 9, and the attachment of mechanical cable 17 can be set either parallel or perpendicular to the axis of the inlet and outlet tubes of the muffler assembly as seen by comparing FIG. 1 to FIG.5.

Muffler silencing chamber 13 is positioned between inlet chamber 4 and outlet chamber 5 adjacent to bypass tube 10. Muffler silencing chamber 13 contains silencer module 14 which is nested with the inlet at silencing chamber inlet 15 and the outlet at silencing chamber outlet 16. Silencer module 14 consists of an aftermarket automotive muffler, which can be integrated into muffler silencing chamber 13, and provide various tones and depths of sound depending on the application.

Mechanical cable 17 transmits the mechanical output of DC motor unit 20 to bypass valve lever 7 through the linear motion of the mechanical cable wire core 19. At the muffler assembly, mechanical cable wire core 19 is attached to bypass valve lever 7 by extending through an opening at that end of bypass valve lever 7. Mechanical cable insulation 18 is set at a fixed position relative to muffler housing 1 to provide the transmission of the mechanical output of DC motor unit 20 as the linear motion of mechanical cable wire core 19. At the actuator unit end of mechanical cable 17, mechanical cable wire core 19 is attached to the actuator lever 21 of DC motor unit 20, by extending through an opening at that end of actuator lever 21. Mechanical cable. insulation 17 is set at a fixed position relative to the frame of DC motor unit 20, allowing for the linear movement of mechanical cable wire core 19 resulting from the rotating mechanical output of actuator lever 21. Mechanical cable wire core 19 consists of either a solid single or multi-stranded wire core that provides the transmission of the mechanical output of DC motor unit 20 to valve lever 7 through the tensioning of valve lever spring 9.

As the actuator, DC motor unit 20 is composed of a 12 volt DC motor whose rotational output is geared down to a lower speed with higher torque capability. The activation of DC motor unit 20 is provided though a switching device that produces a reversing polarity 12 volt DC output. The geared rotational output of DC motor unit 20 is transmitted to the DC motor unit end of mechanical cable 17 through the actuator lever 21. Actuator lever 21 is at one end the rotational pivot point and at the other end the attachment to mechanical cable 17. Actuator lever 21 is attached at its pivot point to the axis of the rotating mechanical output of DC motor unit 20 using arc welding methods. At its opposite end, actuator lever 21 is attached to mechanical cable wire core 19 by extending mechanical cable wire core 19 through an opening at that end of actuator lever 21. The frame of DC motor unit 20 is then attached to mechanical cable insulation 18 to allow for the linear movement of mechanical cable wire core 19 resulting from the mechanical output created from actuator lever 21.

What I claim as my invention is:

1. An exhaust muffler assembly comprised of an outer housing, an inlet tube protruding into said housing, an outlet tube protruding into said housing, a muffler silencing chamber containing muffler silencer module positioned within said housing, said muffler silencing chamber dividing interior of said housing into input chamber, output chamber, and bypass tube, said input chamber creating flow path from said inlet tube to inlet of said bypass tube and to inlet of said muffler silencing chamber, said output chamber creating paths connecting outlet of said bypass tube and outlet of said muffler silencing chamber to said outlet tube of said housing, said housing containing said bypass tube positioned adjacent to the said muffler silencing chamber with said inlet of said bypass tube intersecting said input chamber of said housing and said outlet of said bypass tube intersecting said output chamber of said housing, said bypass tube containing bypass valve, said bypass valve composed of said bypass valve's gate and axle, said axle of said bypass valve gate protruding at one end through said housing and mechanically connected to a bypass valve lever tension spring and mechanical cable via a pivoting bypass valve lever, said bypass valve lever spring connected to said bypass valve lever so as to create tension at all positions of said bypass valve lever and against tension of said mechanical cable, said bypass valve lever tension spring connected at the opposite end to said housing, said mechanical cable comprised of metal wire core with metal wire wound insulation providing linear motion of said wire core within said metal wound insulation through mechanical actuation, said mechanical cable connected at the opposite end to said DC motor actuator unit, said metal wound insulation of said cable affixed to frame of said DC motor actuator unit, said wire core of said mechanical cable fastened to output shaft, pulley, or lever of said DC motor actuator unit, said DC motor actuator unit energized by DC voltage switched source supplying forward, off, and reverse polarity settings.

2. An arrangement in accordance with claim 1, wherein; said DC motor actuator unit is mechanically attached via mechanical control cable to the said exhaust muffler at the said bypass valve to electromechanically control the position of the said bypass valve, the said bypass valve positioned to redirect the exhaust flow either through said bypass tube or through said silencing chamber, said exhaust muffler silencer module contained within said silencing chamber is composed of a complete exhaust muffler unit employing absorption, deflection, and cancellation principles of sound attenuation in any combinations, configuration and noise dampening capability of said exhaust muffler silencer module assembly to vary depending on the maximum silencing level of the application, inlet of said muffler silencing chamber containing said muffler module positioned to intersect said input chamber of said housing, outlet of said muffler silencing chamber containing said muffler module positioned to intersect said output chamber of said housing.

3. An arrangement in accordance with claim 1, wherein; said bypass tube is positioned adjacent to said muffler module silencing chamber extending with the said inlet of said bypass tube intersecting the said input chamber of said housing and the said outlet of the said bypass tube intersecting the said output chamber of said housing, said bypass valve positioned so said bypass valve gate rotates along the axis perpendicular to that of the said bypass tube, axle of said bypass valve gate protruding through said housing allowing attachment to said bypass valve lever, pivot of said bypass valve gate positioned to create full bypass of exhaust flow through the rotation of said bypass valve gate either as a direct path at the open position of said bypass valve from said inlet tube of said housing, to said input chamber, to said inlet of said bypass tube, through said bypass tube, to said outlet of said bypass tube, to said output chamber, and finally through the said outlet tube of said housing, or a bypassed path at the closed position, from said inlet tube of said housing to the said input chamber, through said silencing chamber, to said output chamber, and finally through said outlet tube of said housing.

4. An arrangement in accordance with claim 1, wherein; said input chamber of said housing is positioned at said inlet tube of said housing intersecting said inlet of said silencing chamber and said inlet of said bypass tube, to said inlet tube of said housing.

5. An arrangement in accordance with claim 1, wherein; said output chamber of said housing is positioned at said outlet tube of said housing intersecting said outlet of said silencing chamber and said outlet of said bypass tube, to said outlet tube of said housing.

6. An arrangement in accordance with claim 1, wherein; said axle of said bypass valve gate is attached to said bypass valve lever at pivot point of said bypass valve lever, perpendicular to the length of said bypass valve lever, positioned between both ends at the outer surface of said muffler housing.

7. An arrangement in accordance with claim 1, wherein; said bypass valve lever is fastened both to the said bypass valve lever spring and said mechanical cable where said bypass valve lever spring will create tension against the movement of said mechanical cable.

8. An arrangement in accordance with claim 1, wherein; said bypass lever tension spring is fastened at one end to said bypass valve lever and fastened at opposite end to said housing at a distance to provide initial tension at all ranges of said bypass lever position and movement of said mechanical cable.

9. An arrangement in accordance with claim 1, wherein; mechanical output of said DC actuator unit is of a linear displacement or rotating lever or pulley configuration, whereas the moving shaft, pulley, or lever is attached to said wire core of said mechanical cable providing the movement of the said wire core within said metal wound insulation of said mechanical cable that will transmit that said linear displacement to the said bypass valve lever.

10. An arrangement in accordance with claim 1, wherein; moving wire core of said mechanical cable is fastened at one end to said bypass valve lever and at opposite end to mechanical output of said DC actuator unit with said wire wound insulation of said mechanical cable fastened at one end to said housing of said exhaust muffler in the vicinity of where the said metal wire core is fastened to the said bypass valve lever and at other end to frame of said DC actuator unit to allow both linear movement of said wire core within the said metal wound insulation and flexibility with respect to curvature of said mechanical cable, keeping said DC actuator unit apart from said housing and away from the high operating temperatures of the whole said exhaust muffler assembly.

11. An arrangement in accordance with claim 1, wherein; said DC actuator unit is fastened at the mechanical output shaft, lever, or pulley to one end of the said metal wire core of said mechanical cable, the insulation of said mechanical cable at the said DC actuator unit attached to the frame of the said DC actuator unit, the mechanical output of said DC actuator unit provided by the activation of the DC motor of said DC actuator unit, geared down to a lower speed with higher output torque.

12. An arrangement in accordance with claim 1, wherein; said DC actuator unit is energized by a DC voltage source controlled through a reversing polarity switching device.

* * * * *